US005944222A

United States Patent [19]

Fuchs et al.

[11] Patent Number: 5,944,222

[45] **Date of Patent: *Aug. 31, 1999**

[54] TAMPER EVIDENT DISCHARGE APPARATUS FOR FLOWABLE MEDIA

[75] Inventors: Karl-Heinz Fuchs; Stefan Ritsche, both of Radolfzell, Germany; Frank P. Bigley, Warminster, Pa.

[73] Assignee: Ing. Erich Pfeiffer GmbH, Germany

[ * ] Notice: This patent is subject to a terminal disclaimer.

[21] Appl. No.: 08/805,809

[22] Filed: Feb. 25, 1997

Related U.S. Application Data

[62] Continuation-in-part of application No. 08/594,055, Jan. 30, 1996, Pat. No. 5,813,570, and a continuation of application No. 08/571,942, filed as application No. PCT/WO95/27568, Feb. 9, 1995, abandoned.

[30] Foreign Application Priority Data

Apr. 8, 1994 [DE] Germany ..... 44 12 041
Jan. 23, 1996 [DE] Germany ..... 296 01 047

[51] Int. Cl.[6] ..... B67D 5/00

[52] U.S. Cl. ..... 222/82; 222/153.13

[58] Field of Search ..... 222/82, 83, 385, 222/402.1, 153.13, 83.5; 604/203

[56] References Cited

U.S. PATENT DOCUMENTS

| | | | |
|---|---|---|---|
| 3,403,823 | 10/1968 | O'Donnell . | |
| 4,017,007 | 4/1977 | Riccio | 222/80 |
| 4,964,069 | 10/1990 | Ely . | |
| 5,307,953 | 5/1994 | Regan . | |
| 5,427,280 | 6/1995 | Fuchs . | |
| 5,469,989 | 11/1995 | Graf et al. . | |
| 5,683,361 | 11/1997 | Elk et al. | 222/82 X |

FOREIGN PATENT DOCUMENTS

| | | |
|---|---|---|
| 546607 | 6/1993 | European Pat. Off. . |
| 1535293 | 8/1968 | France . |
| WO-A-9113689 | 9/1991 | WIPO . |

*Primary Examiner*—Gregory L Huson
*Attorney, Agent, or Firm*—Quarles & Brady

[57] ABSTRACT

A discharge apparatus for flowable media, comprising a basic body having a central, substantially cylindrical portion having upper and lower ends, the upper end having a spray nozzle and the lower end having actuating and gripping shoulders; a pump unit at least partly received by the basic body, the pump unit having: a piston rod holding a hollow needle projecting therefrom; a pump chamber connectable to a discharge opening via a discharge channel; and, a pump cylinder and a pump piston bounded by the pump chamber, the pump cylinder forming a medium reservoir and the pump piston being displaceably guided in the pump cylinder; an actuating sleeve; a ring-shaped fastening element having at least one breakable material bridge integral with the actuating sleeve and destroyable by an actuating force exerted in the pump stroke direction; the fastening element having an L-shaped cross-section having a bottom portion and a substantially cylindrical jacket portion, the actuating sleeve projecting centrally through and beyond the fastening element and the gripping shoulders; the housing having an outer projection surrounded by the fastening element; cooperating snap profiles provided at an outside portion of the outer projection and at an inside portion of the jacket portion; and, an outside housing projection projecting from an underside of the gripping shoulders and surrounded by the fastening element.

1 Claim, 7 Drawing Sheets

TAMPER EVIDENT DISCHARGE APPARATUS FOR FLOWABLE MEDIA

CROSS-REFERENCE TO RELATED APPLICATIONS

This application is a continuation-in-part of a continuation-in-part, U.S. patent application Ser. No. 08/594,055, filed Jan. 30, 1996 now U.S. Pat. No. 5,813,570, and a further continuation of U.S. patent application Ser. No. 08/571,942, filed Oct. 8, 1996 now abandoned which is a 371 of PCT/WO95/27568 filed Feb. 9, 1995.

BACKGROUND OF THE INVENTION

The invention relates to a discharge apparatus for flowable media having a basic body for receiving a medium reservoir and a thrust piston pump, which has a pump piston displaceably on a piston runway between a starting position and a pump stroke end position, as well as a pump chamber connected to a discharge opening of the apparatus by means of a discharge channel and defined by a pump cylinder optionally forming the medium reservoir and the pump piston.

Such a discharge apparatus is described in U.S. Pat. No. 4,964,069. It protects the pump cylinder and a resilient stop constructed in the manner of a snap locking means cooperating in such a way that prior to the discharge of a partial stroke a specific actuating pressure must be applied by the operator, so that after overcoming this pressure point the discharge of the liquid takes place with a certain minimum force and speed. This construction ensures that e.g. on atomizing the medium the pressure from the first instant is sufficient for atomization purposes and that the pump is actuated up to its end, i.e. performs the complete stroke and the entire content of its medium reservoir, which simultaneously forms the pump cylinder, is discharged in one or two strokes. Such single or double dosing or proportioning devices are advantageous for the dispensing of medicaments, which are particularly critical with respect to proportioning, contamination, preservation or other criteria.

U.S. Pat. No. 5,469,989 and U.S. Continuation-in-part patent application Ser. No. 546,428 thereof discloses the use of medium reservoirs for a single discharge stroke, which are sealed by a plug simultaneously serving as the piston, the plug being perforated by a needle for actuation purposes. The medium reservoir is received in a sleeve, which has external projections and which cooperate with corresponding projections on the inside of a casing basic body in the manner of a snap fastening. On actuation it is firstly necessary to overcome the static friction, before said beads slide on the faces against which they engage, so that a pressure point must be overcome.

In the U.S. patent application Ser. No. 08/594,055 filed concurrently with the present application by the co-inventors Karl-Heinz FUCHS and Stefan RITSCHE there is disclosed a discharge apparatus for flowable media comprising a basic body, at least partly receiving, a pump unit having a pump chamber connectable to a discharge opening via a discharge channel, the pump chamber being bounded by a pump cylinder and a pump piston, the pump cylinder forming the medium reservoir, the pump piston being displaceably guided in the pump cylinder, a tamper-evident closure which can be destroyed by an actuating force, including at least one breakable material bridge between the pump unit and the basic body. This is accomplished on one hand by a ring shaped fastening element which is integral with breakable material bridges on the casing or a pump arrangement or by an increased piercing resistance of a ram which pierces through a piston plug. The ring which may be connected with an actuating sleeve receiving the reservoir can be snapped in at lower projections of the apparatus housing. It further contains the idea to provide the pump arrangement with a second ring connected thereto by breakable bridges in order to provide a tamper-evident limit also for a second stroke.

OBJECT OF THE INVENTION

The object of the invention is to so further develop a tamper-evident closure which can be destroyed by an actuating force.

SUMMARY OF THE INVENTION

The tamper-evident closure can in an embodiment of the invention be formed by at least one material bridge between at least one pump portion movable with the pump cylinder and a casing portion connected to the basic body.

Therefore a predetermined breaking point is created between the mutually movable parts of the discharge apparatus, whose intactness is a sure sign that the charge of filling of the medium reservoir is unopened and unused. The user can establish this e.g. optically or by a slight turning of the actuating part. To facilitate checking window cutouts can be provided or parts of the pump can be made from transparent material. It is also possible to use a plastics material, which discolours in the case of a breaking deformation. Marks on the movable portion and the casing would also be possible.

Actuating shoulders serve as a support for two fingers, the thumb pressing on the actuating sleeve to apply an adequate force in order to shear or tear off the material portion. As a result of the force applied simultaneously an adequate actuating force is produced for a reliable actuation of the pump.

The material bridges can e.g. be provided on the outer circumference of the actuating sleeve and between the latter and a ring surrounding said sleeve, which is in turn fixed to the facing part, i.e. to the casing, by snapping in. This makes it possible to manufacture the actuating sleeve separately from the casing.

It is provided if the element which is shaped onto the pump part via the material bridges, encloses a projection of the housing from the outside. In this case, the element covers the connecting gap between the pump part and the housing completely and provides not only an optical and functional merge between pump part and housing but prevents also every possibility of manipulation of the tamper-evident connection. It should be preferably provided that the snap-in connection is secured against drawing off, such that it is destroyed if someone tries to draw off the pump cylinder from the housing. In this case, the material bridges and the tamper-evident closure shall break.

It is especially preferred that the element is a ring with an L-shaped cross section consisting of a substantially radial bottom ring part and an adjacent jacket. The inside of the jacket is preferably provided with a snap profile. This snap profile can cooperate with a correspondingly shaped profile at the ring or ring segment shaped projection in snap acting manner.

BRIEF DESCRIPTION OF THE DRAWINGS

Embodiments of the invention are described in greater detail hereinafter relative to the drawings, wherein show.

specification continued with pages 6 to 16 and drawings to 13 of U.S. CIP Ser. No. 594,055 (our ref.: A 30 136 US).

DESCRIPTION OF EMBODIMENTS

Figure 1:
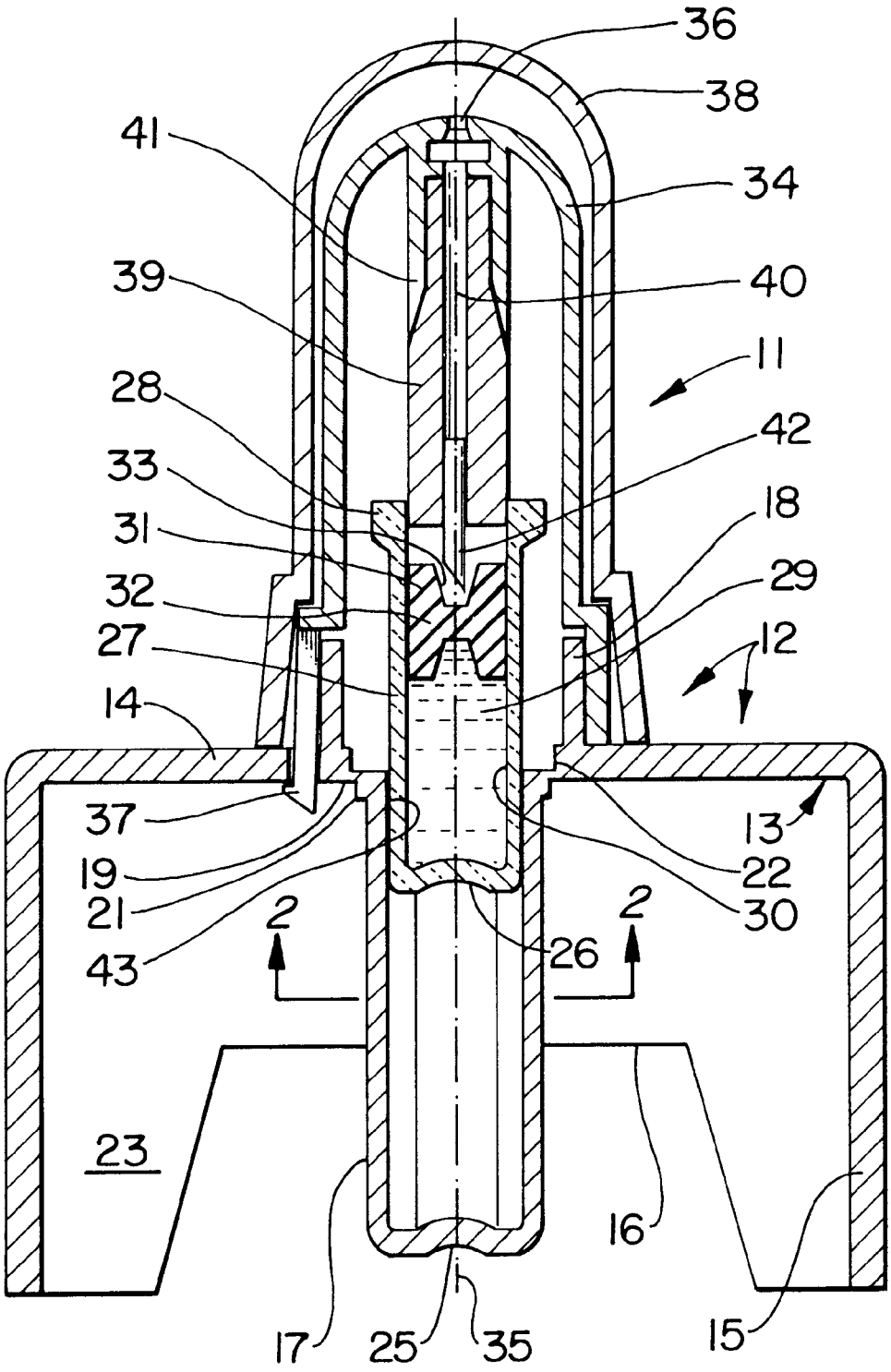
FIG. 1 A longitudinal section through a discharge apparatus with a tamper-evident closure.
Figure 2:
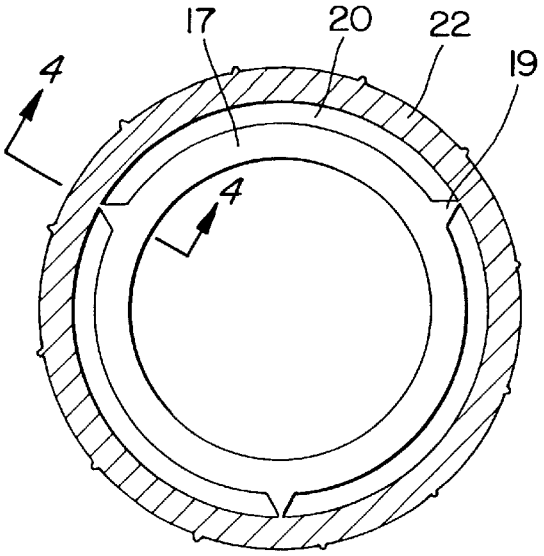
FIG. 2 A view in the direction of the arrow II in FIG. 1.
Figure 3:
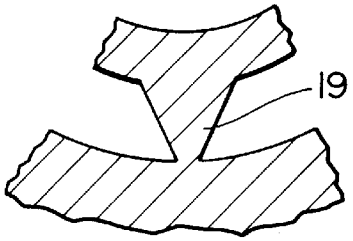
FIG. 3 A detail from FIG. 2, but shown in section.
Figure 4:
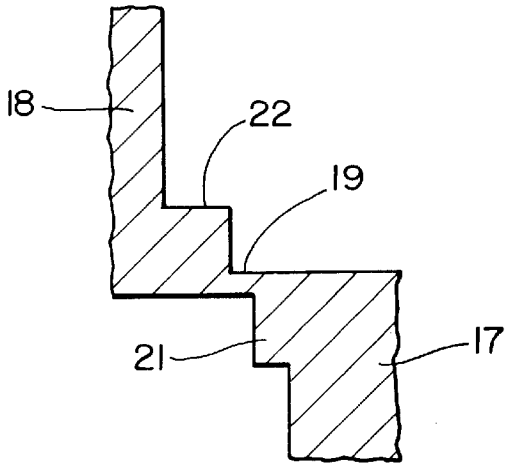
FIG. 4 A section along line IV in FIG. 2

The discharge apparatus 11 shown in FIG. 1 has a two-part basic body 12. It contains a base casing part 13, which has an epaulette-like shape with two actuating shoulders 14 and a jacket 15 connected thereto. The base casing part is flat or flat-oval and has its greatest extension in the drawing plane, whereas it has smaller dimensions transversely thereto. The jacket 15 is longer on the right and left-hand sides in FIG. 1 and has on its two sides roughly parallel to the drawing plane a cutout 16, which is open to the bottom. On the base casing part 13 is injection moulded in one piece an actuating sleeve 17, namely on the lower, inside of a connector 18 projecting upwards from the part 13. The one-piece connection between the base casing part 13 and the actuating sleeve 17 takes place by means of material bridges 19, as shown in FIGS. 2 to 4. The gap 20 between the outer edge of an upper flange 21 of the actuating sleeve and an inner flange projection 22 in the interior of the connector 18 is bridged in the represented embodiment by three thin connecting webs, which have a triangular shape and whose tip is shaped on the web 22, so as to form predetermined breaking points. From the manufacturing standpoint, as a result of correspondingly small recesses, which scarcely exceed the dimensions of a normal flash, they can be formed on the separating face between two plastic injection moulded parts, which on the one hand form the space 23 in the interior of the jacket 15 and on the other the space in the connector 18. Correspondingly the three uniformly, circumferentially distributed material bridges 19 are located in a plane formed by the inside and bottom of the actuating shoulders 14 on the one hand and the upper edge of the flange 21 on the other.

The actuating sleeve 17 has inner ribs 24, which roughly take up ¾ of the length of the sleeve, considered from its bottom 25. On the same is supported the bottom 26 of a pump cylinder 27, which has the shape of a roughly cylindrical, bottom closed sleeve made from glass and having an upper side flange 28. It simultaneously forms the reservoir for the medium 29 to be discharged and the pump cylinder. Its inner circumferential surface consequently forms the piston runway 30 for a piston 31, which is constructed in the form of a rubber or similar elastic material piston plug. In longitudinal section it has a H-shape and is a thick-walled tube, whose outer jacket forms the piston runways, with a central closure web 32 transversely closing the tube interior, so that at the top and bottom, connecting onto the closure web 32 depressions 33 are formed, which can be roughly conical.

The piston plug 31 is located on the hermetically sealed medium 29. Filling takes place with or without air inclusions. The pump cylinder is inserted with slight pressure in the upper part of the actuating sleeve and extends with its largest part over and beyond the actuating shoulders 14 through the connector 18 and into a connector portion 34, which can also be constructed as an adaptor. It is a finger-like portion, which has a substantially cylindrical or slightly conical shaft with an upper, spherical rounding running in the direction of the pump axis 35. In the centre of said rounding is provided the discharge opening 36 in the form of a conventional spray nozzle. However, the discharge opening could also be provided for some other discharge form. e.g. for a dosed delivery of a liquid or pasty medium, or could have other shapes, so as to permit better adaptation of the delivery to the shape of any body opening. Therefore it is also advantageous to manufacture the connector portion 34 separately from the base casing part and is fixed thereto by a snap fastening 37 with e.g. three tabs engaging in openings and provided with a barb-like head, the connector portion being centred on the connector 18. In order to prevent a removal of the connector portion 34, the snap fastening can be constructed in-self-locking manner. A protective sleeve 38 protects the connector portion against contamination.

In the interior of the connector portion there is a piston rod portion 39, which has an inner discharge channel 40 and is inserted in the sleeve 41 shaped inwards on the upper end of the connector portion 34. In said piston rod portion 39 is inserted a ram 42 in the form of a downwardly inclined cut-off, hollow steel needle, e.g. by injecting or pressing into an opening provided with corresponding retaining ribs.

With the exception of the steel needle 42, the piston plug 31 made from rubbery materials and the glass pump cylinder/medium reservoir, all pump parts are plastic injection mouldings.

During manufacture in the component surrounding the base casing part 13 and the actuating sleeve 17 the pump cylinder 27 is inserted from above in the receptacle 43 formed in the actuating sleeve 17. Said cylinder 27 contains the medium 29 tightly sealed through the piston plug 31.

This is followed by the mounting of the connector portion, on which have been preassembled the piston rod portion and the ram 42 and it engages in the base casing part and is fixed via the snap fastening 37. Thus, after fitting the protective sleeve 38, the discharge apparatus is assembled. For use purposes, following the removal by the user of the protective sleeve 38, the discharge apparatus is taken up between three fingers, two fingers resting on the shoulders 14 and the thumb on the bottom 25 of the actuating sleeve 17. The thumb engages in the window-like cutout 16 and consequently has an adequate actuating clearance. The discharge opening 36 is directed onto the corresponding point and by a powerful pressure on the actuating sleeve the actuating pressure is built up to such an extent that the predetermined breaking points formed by the material bridges 9 tear or shear and the actuating sleeve can be moved upwards together with the pump cylinder. As a result of the prior, powerful pressure build-up this takes place with a high speed, which ensures a speedy performance of the discharge stroke taking place. The pump cylinder is moved upwards against the ram 42, so that the latter pieces the central web 32 of the piston plug, but as a result of the elasticity of the piston plug material is immediately resealed on the outer face. Only through the inner channel of the ram constructed as a hollow needle can the medium escape upwards through the discharge channel 40 and the discharge opening 36 and is delivered there in sprayed or correspondingly proportioned manner. The lower edge of the piston rod portion 39 can engage on the upper face of the piston plug 31 and consequently produce a direct pressure connection with the piston, which runs downwards along the piston runway 30 and conveys the medium to the discharge opening. The length of the needle should be such that it does not project over the lower boundary of the piston plug 31, so that an almost complete discharge of the in certain circumstances very expensive medium is ensured.

Thus, the discharge apparatus offers a possibility of discharging sensitive and expensive materials in a planned and precisely dosed manner. Through the tamper-evidence closure operating with material destruction it is possible at any time to check intactness and it is ensured that there is a complete delivery of the medium with an adequate actuating pressure. The apparatus is simple to manufacture and fit, whilst can easily be adapted to different circumstances, e.g. by different adaptor shapes. Following actuation the unit comprising the pump cylinder 27 and actuating sleeve is loose and can optionally be drawn out in the downwards direction. The pump cylinder 27 with the pump plug 31 can be removed, so that the remainder, with the exception of the small needle, is made from one type of material optionally plastic and can be correspondingly disposed of.

Figure 5:
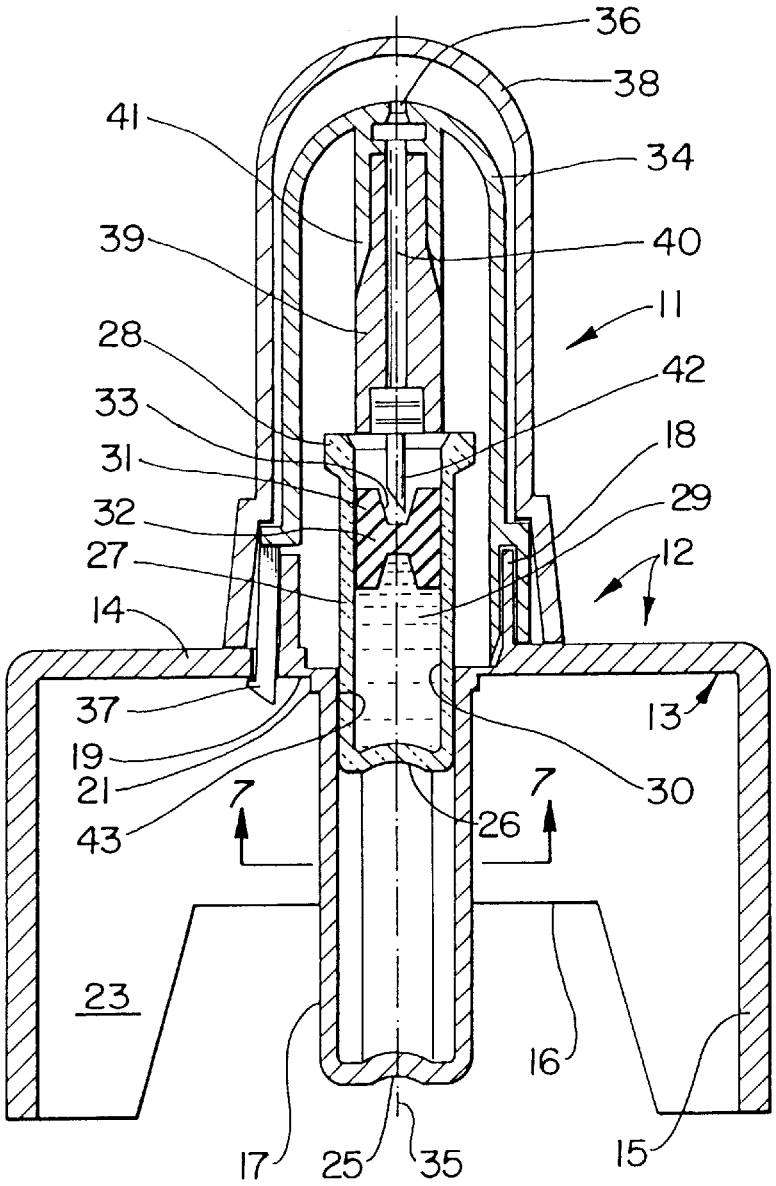
FIG. 5 A modified embodiment of the discharge apparatus according to FIG. 1 in longitudinal section.

In the embodiment according to FIG. 5 all parts and functions are identical with those of FIGS. 1 to 4, apart from the following exceptions.

Figure 7:
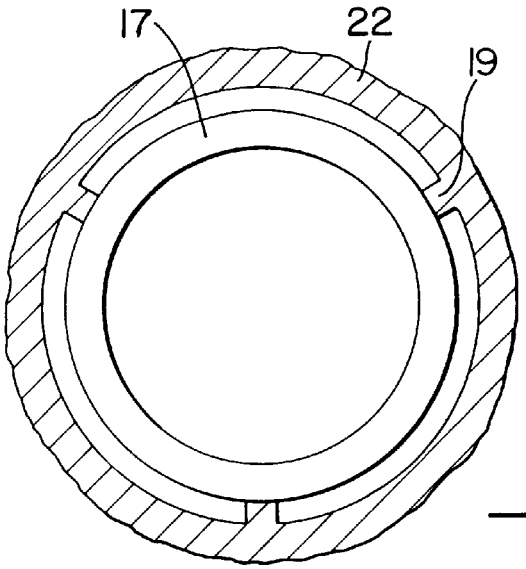
FIG. 7 A view in the direction of arrow VII in FIG. 5.

As shown in FIG. 7, the material bridges 19 are constructed as strip-shaped webs and consequently have no such marked, almost punctiform predetermined breaking point as in the case of the triangular material bridges of FIGS. 2 and 3. However, in order to ensure a clean and precise separation, a cutting edge 55 is provided, which in the represented embodiment is shaped onto a lower inner edge of the connector portion 34. The latter engages in the manner of a circular pocket over the connector 18 of the base casing part 13.

In the unoperated state the cutting edge 55 rests on the material bridge or projects somewhat over it. On actuation the material bridge is pressed against the cutting edge 55 and cut off, which is particularly advantageous if the material has a considerable breaking elongation. This cutting edge construction could also be provided on other pump components and used with other material bridge shapes. When reference is made hereinbefore to three circumferential material bridges, this merely represents an advantageous construction permitting a tilt-free actuation, without there having to be an excessive number of material bridges, but a different number could also be chosen.

Figure 8:
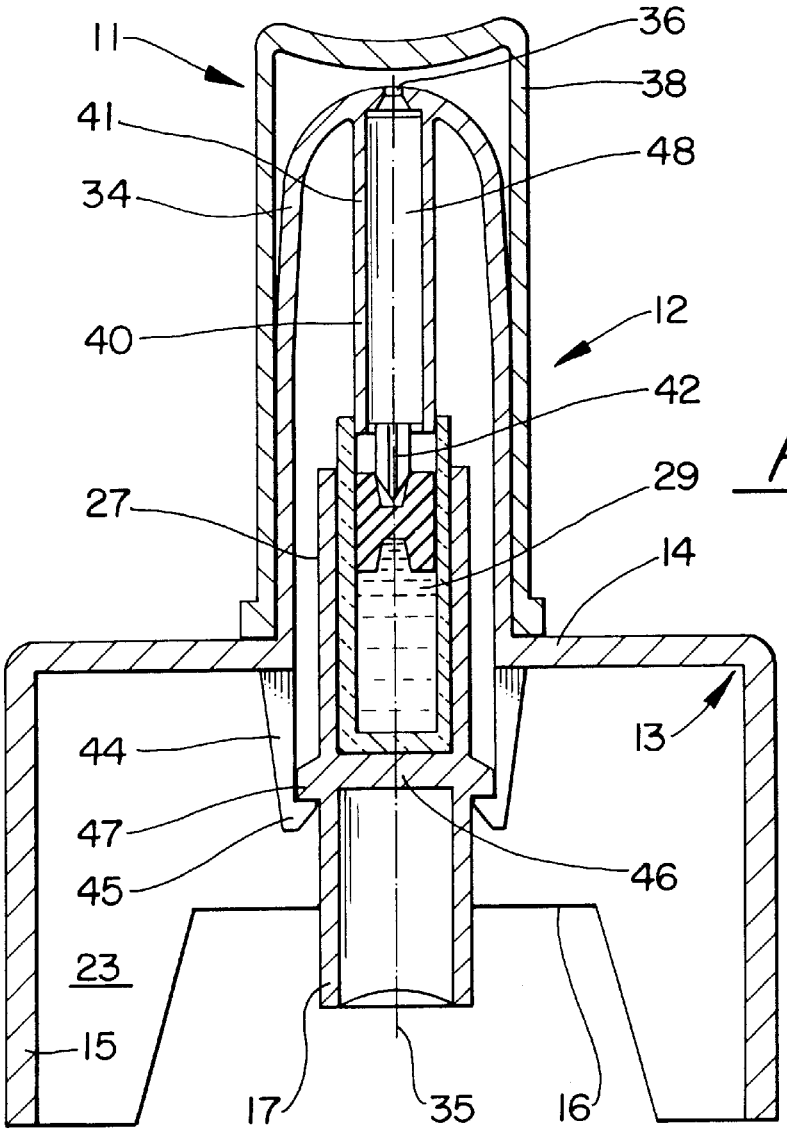
FIG. 8 A longitudinal section through another embodiment of the discharge apparatus.

FIG. 8 shows an embodiment which, with respect to the shaping of the basic body 12, is largely the same as those described hereinbefore. However, in this case the basic body 12 with the base casing part 13 and the connector portion 34 are made from a plastics part. At the bottom. i.e. into the space 34 retaining clips 44, whose ends have barb-like latching projections, are connected to the connector portion 34.

In place of the lower bottom 25, the actuating sleeve 17 has an intermediate bottom 46, which bounds the receptacle 43 for the pump cylinder 27 and an outer guide flange 47, which engages on the substantially axially directed inside of the retaining clips 44, which run in the extension of the inner faces of the connector portion 34.

Figure 10:
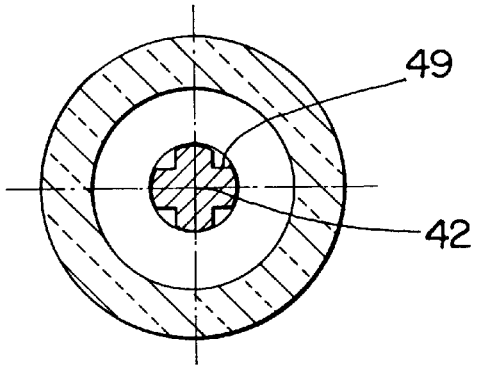
FIG. 10 A cross-section along line X in FIG. 9.

The spray nozzle forming the discharge opening is formed between the latter and the piston rod insert 48, which is located in a sleeve 41 extended up to the pump cylinder and which is shaped in the interior of the connector portion 34. The piston rod insert 48 is pressed in there and has a lateral discharge channel 40 in the form of a groove and on its upper end face corresponding spiral groove constructions, which belong to the vortex die. On to the underside of the piston rod insert is shaped the ram 42 which, like the latter, is made from plastic. It is downwardly tapered or provided with a cutting edge and has a cruciform cross-section as can be seen in FIG. 10. Between the cross ribs are formed channels 49.

Figure 9:
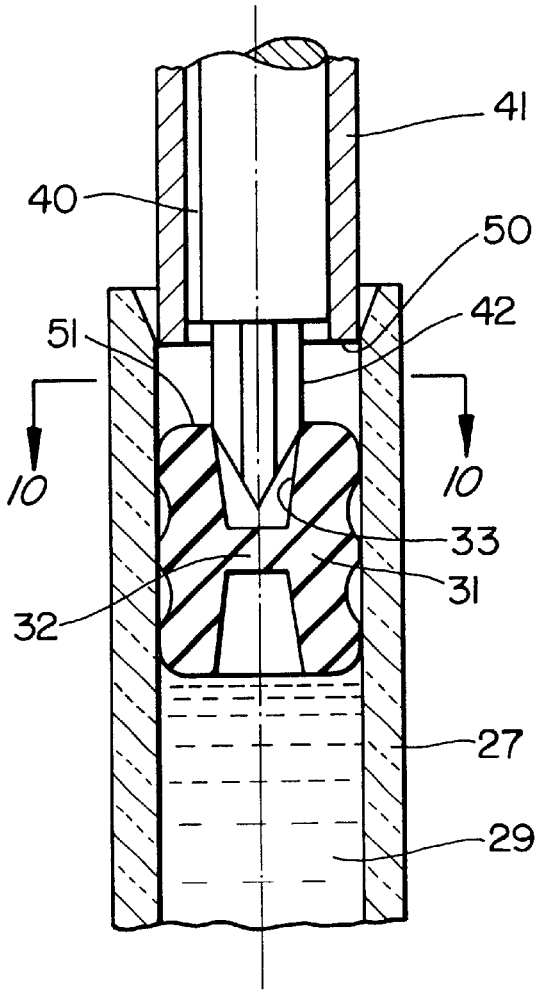
FIG. 9 A detail of FIG. 8.

As can in particular be gathered from FIG. 9, the external dimensions of the ram are so large that it must be pressed into the depression 33 on the piston plug 31.

Figure 6:
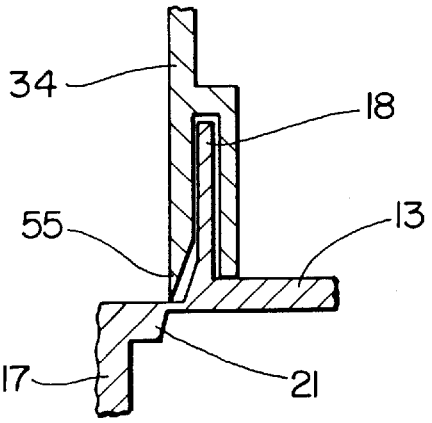
FIG. 6 A detail from FIG. 5.

All the remaining parts are the same as in the previous embodiments and are given the same reference numerals in FIGS. 5 to 7 as in FIGS. 1 to 4.

In this embodiment assembly can take place by plugging together two preassembled units, namely on the one hand the basic body 12 in which has been pressed the piston rod insert 48, and on the other the unit comprising the actuating sleeve 17 and the filled and sealed pump cylinder 27 inserted therein. Insertion can cake place from the bottom in the axial direction until the guide flange 47 engages behind the latching projections 45.

During actuation pressure is exerted on the lower end of the actuating sleeve 17. As in WO 92/00812, the forces resulting from the static friction between the engaging parts 44, 47 must be overcome and the ram 42, accompanied by the deformation of the piston plug must be forced into the latter until the closure web 32 is pierced. This requires a relatively high actuating force, which is deliberately chosen higher than would normally be necessary for piercing the web 32. Under the pressure of the ram, the piston plug cannot be pressed further into the pump cylinder, because the medium is normally incompressible. Only after the piercing of the closure web can it pass out upwards through the channels 49. The latter have in the meantime been sealed to the outside by the inner wall of the depressions 33 and by the engaging of the lower face 50 of the sleeve 41 on the upper edge 51 of the closure plug 31, so that the medium is passed through the discharge channel 40 to the discharge opening 36.

Figure 11:
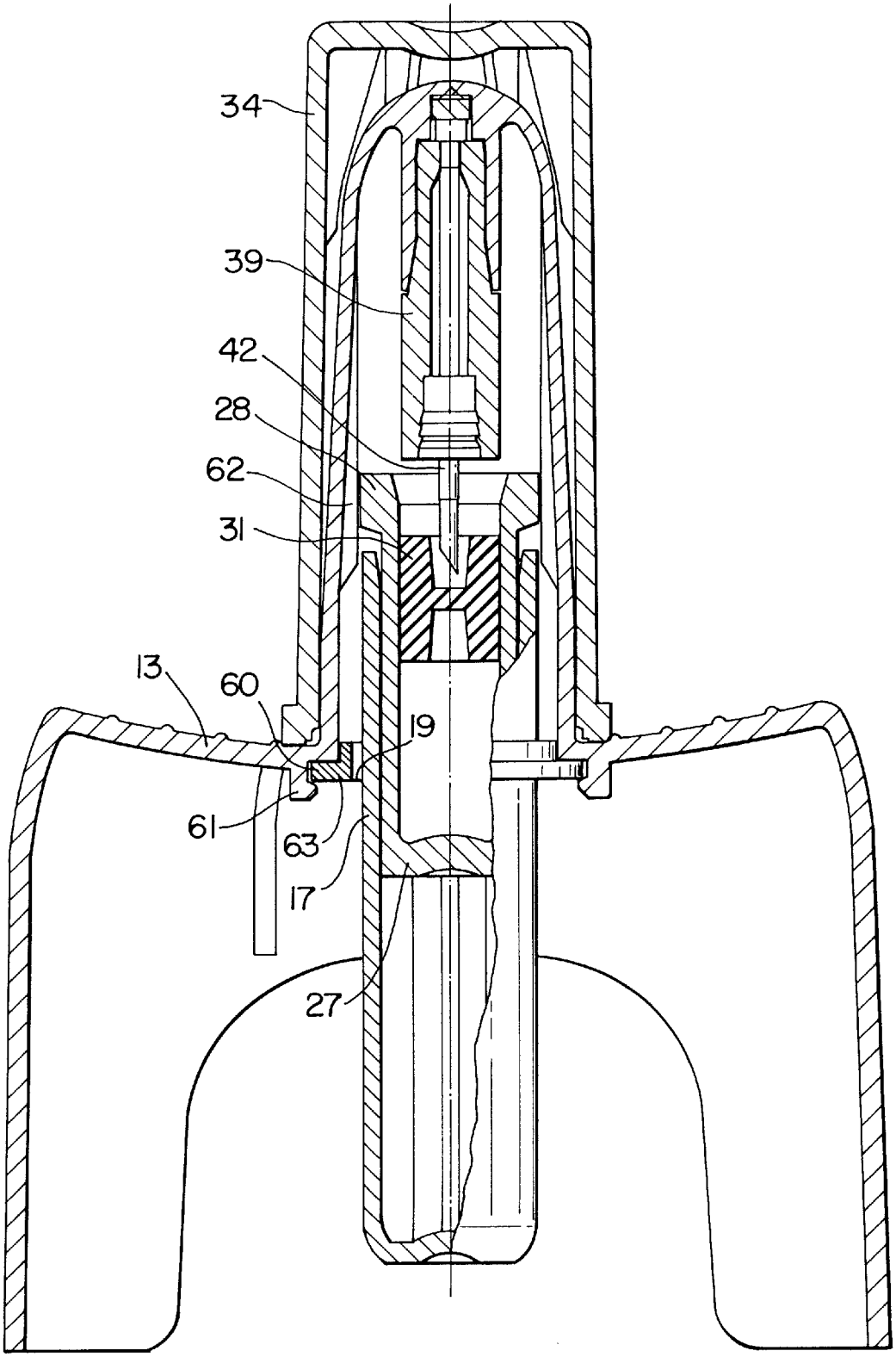
FIG. 11 A partial longitudinal section through an embodiment with a shaped on tamper-evidence closure ring.

FIG. 11 shows in longitudinal section a detail of an embodiment, in which the casing 13 and connector portion 34, as in FIG. 8, are constructed in one piece. Otherwise the construction is similar to FIGS. 1 and 5. The same reference numerals are used for the same parts and reference is made to the previous description of said parts and their function.

On the actuating sleeve 17, which receives the container 27, is provided on the outside a fastening element 60 in the form of an all-round ring with a L-shaped cross-section. It is connected to the actuating sleeve 17 by several material bridges 19, which are so constructed and dimensioned, that they tear away under the actuating pressure and consequently separate the ring from the actuating sleeve. The fastening element 60, actuating sleeve 17 and material bridges 19 are injection moulded from plastic in one piece.

The fastening element 60 is fixed to the casing 13 by a snap connection 61. The fastening element is centred with its axial leg on the inside of the connector portion 35, whereas the outwardly directed leg latches in a depression at the transition between the actuating shoulder 14 and the connector portion 34.

During assembly the actuating sleeve is introduced together with the container 27 forming the pump cylinder. An assembly tool can press the lower engagement face 63 of the actuating element 60 in FIG. 11, so that engagement of the latching connection 61 takes place without any risk of damage to the tamper-evident closure formed by the material bridges 19. However, if the user moves the sleeve upwards, the material bridges 19 tear and the actuating sleeve, together with the pump cylinder/container 27, can perform the pump stroke in the previously described manner. The actuating sleeve 17 is guided on the one hand in the circular fastening element 60 (between the torn off material bridges) and on the other on the inner webs 62 of the connector portion 34. An outer flange of the container/pump cylinder 27 is also guided in this way, which prevents tilting of the actuating means. The material bridges 19 can also be constructed as split or through film connections.

The fastening element 60 has a certain amount of axial and radial clearance in the latching connection 61. This makes it possible to intentionally or unintentionally turn the actuating sleeve 17 without destroying the tamper-evident closure. However, the latching connection must be sufficiently strong that on drawing off the actuating sleeve 17 in the downwards direction the tamper-evident closure tears. This ensures that there have been no undesired manipulation of the content of the proportioning device.

Thus, a tamper-evidence closure has been provided, which requires a higher, material-destroying actuating force in order to unseal the medium reservoir 27, than would be needed in the case of a simple needle. This is aided by the frictional force between the guide flange 47 and the retaining clips 44 which, after overcoming the static friction, pass into the sliding state and therefore release a larger proportion of the expended actuating force for actuation and overcoming the ocher resistances.

Figure 12:
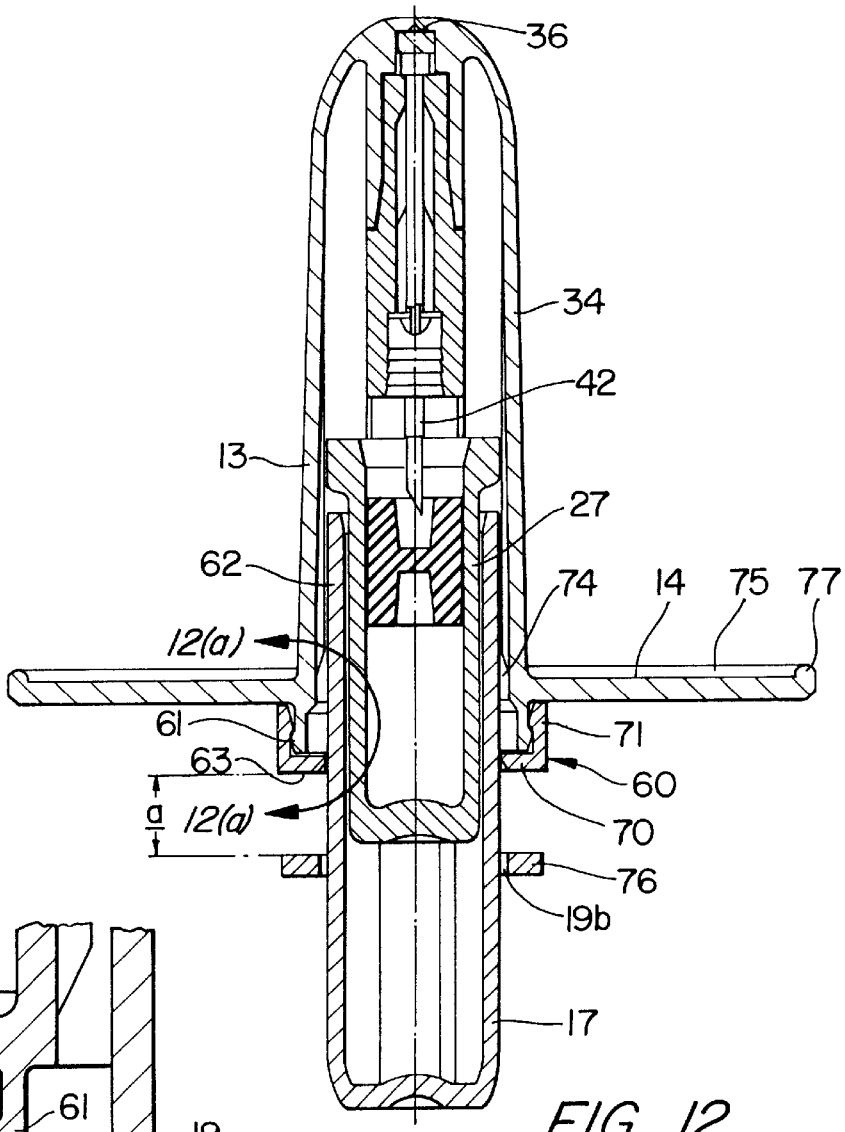
FIG. 12*a* a longitudinal section through a further preferred embodiment large view.
FIG. 12*b* a longitudinal section through a further preferred embodiment of an expanded view.
Figure 12A:
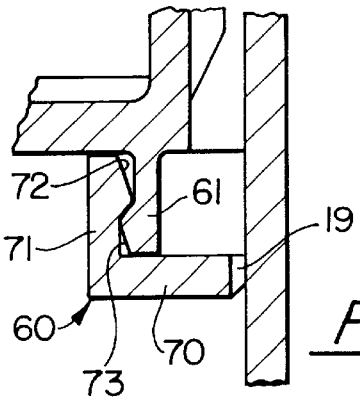
Figure 13:
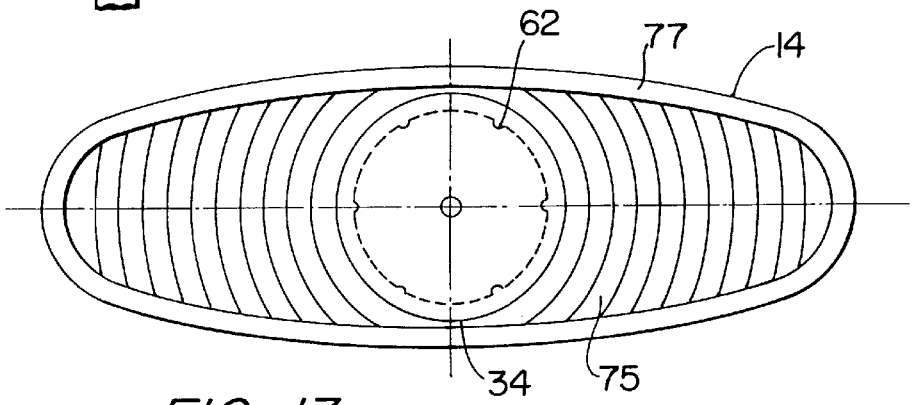
FIG. 13 a top view of the embodiment of FIG. 12.

FIGS. 12 and 13 show a preferred embodiment which has the same structural and functional features as the embodiment of FIG. 11. Here also the same reference numerals are used for the same parts and reference is made to previous description of those parts and their function.

The element 60 which is connected to the actuating sleeve 17 by the material bridges 19, is a ring with an L-shaped cross section. Accordingly it has a bottom ring 70 which has at its inner side the material bridges 19 connecting the bottom ring 70 integrally with the actuating sleeve 17. Parallel and concentric with the actuating sleeve 17 is a jacket 71. At the inner surface of the jacket 71 there is provided a snap profile 72 which can e.g. consist of a barbed ring projection (see the enlarged detail in the dash-dotted circle in FIG. 12)

The element 60 covers a housing projection 61, which is ring-shaped and surrounds the middle housing opening 74, in which the pump cylinder 27 and its actuating sleeve 17 is contained. The projection 61 projects cover the housing 13 to below. The projection 61 can have a ring or tubular shape or be in the shape of several segments arranged in ring-shaped manner. At its outside it has a counter profile 63 matching to the snap profile 72 of the jacket.

Its snap action is provided such that during mounting of the unit actuating sleeve/pump cylinder 17, 27 in the housing opening 74 the element 60 is fixed by snap action at the housing projection 61 and covers the latter. The power needed for snapping-on is such that during snapping-on the material bridges will not be over-stressed. If, however, a power in the counter direction is exerted which could lead to a withdrawal of the actuating sleeve 17 to below, the barbed shape of the snap means 72, 73 provide that the material bridges 19 will be destroyed, thereby clearly evidencing tamper.

While in the embodiment of FIG. 11 the housing has a housing jacket 15 projecting to below, the embodiment of FIGS. 12 and 13 provides actuating shoulders 14 having the shape of flat housing projection (FIG. 13) projecting laterally far past the main portion 34 of the housing in two opposite directions. It has a generally oval shape. It enables a safe grip of the apparatus between two fingers when pressing the thumb on the lower bottom 25 of the actuating sleeve. Ribs 65 which are to be seen from FIG. 13 in the in shape provide good grip and stiffening, especially by a peripheral edge rib 77 projecting to above.

Thereby, material will be saved without impairing stability, which is of great importance for a single use product. Further the lower surface of the actuating shoulder 14 can be used for attaching markings, for instance batch numbers. The actuating sleeve 17 can also be used for labels or other visual marks.

At the outer circumference of the actuating sleeve 17 there is provided a second ring-shaped element 76 at the distance a from the lower surface 63 of element 70. Like element 70, the second element 76 is also molded in one piece with the actuating sleeve via material bridges 19b which may be of the kind as shown in FIGS. 2 to 4. They may however be somewhat stronger than those of element 60.

This embodiment provides a double stroke discharge device, i.e. a discharge or spray device which is able to discharge two exactly proportioned charges after each other. The ring-shaped element 76 terminates the operation after the first part of the stroke, equivalent to the distance a. At this end of this part of the stroke the operation force (counter pressure of the liquid etc.) and the force for breaking the material bridges 19 are adding up. It is therefore unlikely that the user overruns the second ring unintentionally.

After this stop, which is usually half the way of the complete stroke, the user can break also the material bridges 19*b* by an increased pressure on the pump part. When breaking the material bridges 19*b*, the ring-shaped element 76 abuts the contact surface 63 of element-60.

After the first part of the stroke of this two stroke discharge apparatus, the container or pump cylinder 26 is open via the hollow needle 36. For the use of a nasal spray, this embodiment is however very advantageous for applying a medicine into both nostrils consecutively but in even proportion. The second stroke is thereby also tamper-proof.

It is to be noted that the embodiment of FIG. 12 provides a closed and uncomplicated discharge apparatus which is easy to operate and to pack.

What is claimed is:

1. A discharge apparatus for flowable media, comprising:

a basic body having a central, substantially cylindrical portion having upper and lower ends, said upper end having a spray nozzle and said lower end having actuating and gripping shoulders, said shoulders including a generally flat radial projection of considerably greater dimensions in two opposing directions than in a direction perpendicular thereto;

a pump unit at least partly received by said basic body, said pump unit having:

a piston rod holding a hollow needle projecting therefrom;

a pump chamber connectable to a discharge opening via a discharge channel; and, a pump cylinder and a pump piston bounded by said pump chamber, said pump cylinder forming a medium reservoir and said pump piston being displaceably guided in said pump cylinder for discharging all said medium contained in said medium reservoir by a single pump stroke in a pump stroke direction after being pierced by said hollow needle under action of said piston rod;

an actuating sleeve for at least partly receiving said pump unit;

a ring-shaped fastening element having at least one breakable material bridge integral with said actuating sleeve and destroyable by an actuating force exerted in said pump stroke direction, thereby providing a destroyable tamper-evident closure;

said fastening element having an L-shaped cross-section having a bottom portion and a substantially cylindrical jacket portion, said actuating sleeve projecting centrally through and beyond said fastening element and said gripping shoulders;

said housing having an outer projection surrounded by said fastening element;

cooperating snap profiles provided at an outside portion of said outer projection and at an inside portion of said jacket portion, said snap profiles being barb-like to provide a smaller holding force in a snapping-in direction than in a direction opposite thereto, said holding force in said opposite direction being greater than said actuating force; and, an outside housing projection projecting from an underside of said gripping shoulders and surrounded by said fastening element.

* * * * *